US006223661B1

(12) United States Patent
Griepentrog

(10) Patent No.: US 6,223,661 B1
(45) Date of Patent: May 1, 2001

(54) FOLDING ROLL-AWAY TABLE

(75) Inventor: Dennis G. Griepentrog, DePere, WI (US)

(73) Assignee: Krueger International, Inc., Green Bay, WI (US)

( * ) Notice: Subject to any disclaimer, the term of this patent is extended or adjusted under 35 U.S.C. 154(b) by 0 days.

(21) Appl. No.: 09/441,237

(22) Filed: Nov. 16, 1999

(51) Int. Cl.[7] ..... A47B 3/087

(52) U.S. Cl. ..... 108/169; 108/173; 108/166; 108/115

(58) Field of Search ..... 108/168, 169, 108/171, 173, 174, 176, 179

(56) References Cited

U.S. PATENT DOCUMENTS

| | | | |
|---|---|---|---|
| Re. 24,454 | | 4/1958 | Wilson . |
| 2,721,778 | * | 10/1955 | Wilson ..... 108/173 X |
| 2,747,958 | | 5/1956 | Wilson . |
| 2,764,460 | | 9/1956 | Nelson . |
| 2,766,089 | | 10/1956 | Nielsen . |
| 2,777,742 | | 1/1957 | Schieber . |
| 2,831,740 | | 4/1958 | Schieber . |
| 2,831,741 | | 4/1958 | Wilson . |
| 2,873,157 | | 2/1959 | Wilson . |
| 2,879,120 | | 3/1959 | Howe et al. . |
| 2,901,304 | | 8/1959 | Fihe . |
| 3,080,833 | | 3/1963 | Risdall . |
| 3,080,834 | | 3/1963 | Risdall . |
| 3,101,062 | | 8/1963 | Kanzelberger . |
| 3,140,674 | | 7/1964 | Cisler . |
| 3,143,982 | | 8/1964 | Blink et al. . |
| 3,212,463 | | 10/1965 | Anderson et al. . |
| 3,245,363 | | 4/1966 | Amthor, Jr. et al. . |
| 3,276,401 | | 10/1966 | Wilson et al. . |
| 3,476,061 | | 11/1969 | Takahashi . |
| 3,799,073 | | 3/1974 | Nielsen . |
| 3,884,160 | | 5/1975 | Gutierrez . |
| 4,027,600 | | 6/1977 | Mueller . |
| 4,054,096 | | 10/1977 | Wilson et al. . |
| 4,131,311 | | 12/1978 | Nikitits et al. . |
| 4,223,945 | | 9/1980 | Nikitits . |
| 4,489,661 | | 12/1984 | Fitzgerald . |
| 4,596,196 | | 6/1986 | Gunter et al. . |
| 4,819,569 | | 4/1989 | Bastian et al. . |
| 4,826,244 | | 5/1989 | Choi . |
| 5,029,938 | | 7/1991 | Song . |
| 5,080,024 | | 1/1992 | Yamamoto . |

FOREIGN PATENT DOCUMENTS

1280051 * 11/1961 (FR) ..... 108/173 X

* cited by examiner

*Primary Examiner*—Peter M. Cuomo
*Assistant Examiner*—Michael J. Fisher
(74) *Attorney, Agent, or Firm*—Andrus, Sceales, Starke & Sawall, LLP

(57) ABSTRACT

A folding sectional table assembly includes a pair of table sections, each of which includes a table top and leg structure pivotably mounted to the table top. Each leg structure includes a pair of upper tubular members pivotably mounted between a pair of apron members secured to the underside of the table top, for providing pivoting movement of the leg structure relative to the table top. A torsion bar assist mechanism is disposed within selected ones of the upper tubular members of the leg structures, and includes a torsion bar located within an internal passage defined by the upper tubular member. Each end of the upper tubular member is pivotably mounted to a hub member secured to one of the apron members. One end of the torsion bar is engaged with a torsion bar retainer mounted to one of the hub members, and a torsion bar driver is mounted to the upper tubular member at a location spaced from the torsion bar retainer, and engages the torsion bar to twist the torsion bar during pivoting movement between the table top and the leg structure. A pneumatic cylinder assembly is interconnected with each table section for cushioning the table sections as the table sections are lowered, and also to provide a spring biased assist in lifting the table sections for folding. At least one pair of hinge plates interconnect the table sections. Each cylinder assembly is interconnected at one end with a hinge pin which pivotably interconnects the hinge plates, and at the other end to one of the leg structures.

20 Claims, 13 Drawing Sheets

FIG. 10
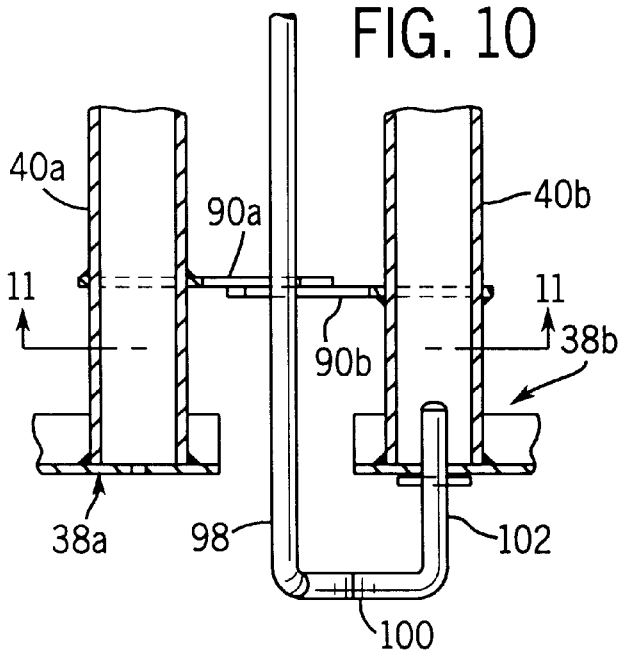
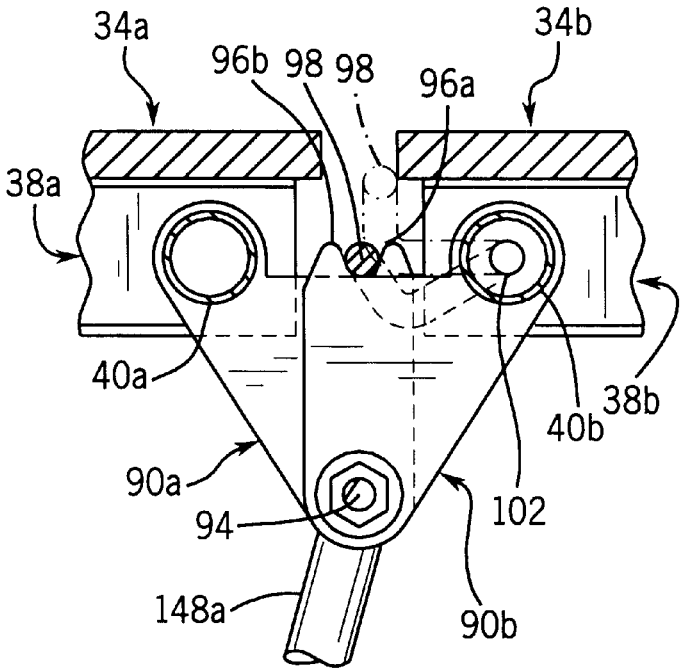
FIG. 11

FOLDING ROLL-AWAY TABLE

BACKGROUND AND SUMMARY OF THE INVENTION

This invention relates to tables, and more particularly to a folding roll-away table assembly in which a pair of table sections are foldably interconnected with each other and are movable between a folded, storage position and an unfolded, operative position.

Folding sectional roll-away table assemblies are commonly used in applications where table space is required on an intermittent basis. One common application is school cafeterias, gymnasiums or multi-purpose rooms, which require table space for eating or other activities at certain times, and which are often used at other times for activities which do not require table space. Folding sectional tables are commonly used in such applications, and can be quickly folded and rolled away for storage in order to clear the area for uses in which table space is not required. Typically, folding sectional tables of this type have a frame which carries a predetermined number of seats or benches, so that it is not necessary to set up and knock down chairs when table space is required.

Numerous folding table assemblies are known in the art, and various folding mechanisms and assist arrangements are known for providing movement of the table assembly between its folded, storage position and its unfolded, operative position. For example, it is known to provide one or more torsion bars interconnected with the frame or legs of the table. In the past, however, torsion bar assist assemblies have required a separate mounting arrangement interconnected with the frame, which adds to the cost and complexity of the frame.

Prior art folding sectional tables have required a user to exert an upward force on the table sections as the table sections are being lowered toward the unfolded, operative position, in order to prevent the table sections from unfolding too quickly after the table sections have attained a predetermined position during downward movement. As can be appreciated, the table sections are quite heavy, and unrestrained downward movement can cause undesirably fast opening of the table.

In addition, prior art folding sectional tables include a latch arrangement for selectively maintaining the table assembly in its folded, storage position. The latch arrangement includes a latch member located at the center of one of the table sections, which is engageable with a catch member mounted to the other of the table sections. In order to unfold the table sections, the user has been required to reach into the center of the folded table assembly and to lift or move the latch member out of engagement with the catch member. This is a somewhat complicated motion, in that the user must then withdraw his or her hand from inside the folded table assembly and operate the table assembly for movement toward its unfolded, operative position.

It is an object of the present invention to provide an improved folding sectional table assembly which is extremely easy to operate and which provides controlled movement between its unfolded, operative position and its folded, storage position. It is a further object of the invention to provide such a table assembly which incorporates a cushioning system for providing controlled downward movement of the table assembly from its folded, storage position toward its unfolded, operative position. Yet another object of the invention is to provide such a table assembly which incorporates a unique torsion bar mounting arrangement which does not require a separate structure for interconnecting torsion bars with the table frame. Yet another object of the invention is to provide such a table assembly which combines the advantages of a torsion bar system for aiding in folding of the table assembly, and the advantages of a pneumatic cylinder arrangement for cushioning the table assembly during unfolding and for assisting in moving the table assembly away from its unfolded, operative position and toward its folded, storage position. A still further object of the invention is to provide such a table assembly which utilizes a unique latch arrangement which is easy to operate and which eliminates complicated movements in unlatching the table sections and moving the table sections away from the folded, storage position and toward the unfolded, operative position.

The invention is incorporated into a folding table assembly which includes first and second table sections, each of which includes a table top and a frame including a leg arrangement for supporting the table top above a supporting surface. Each table section further includes one or more hinge members, and the hinge members of the table sections are pivotably interconnected with each other for providing pivoting movement of the table sections between the unfolded, operative position and the folded, storage position. The leg arrangement of each table section is pivotably interconnected with the table section so as to be movable toward the table section when the table assembly is moved toward its folded, storage position, and movable away from the table top to an extended position when the table assembly is moved toward its unfolded, operative position.

In accordance with one aspect of the invention, a combination torsion bar system and pneumatic cylinder arrangement functions to assist in moving the table assembly from its folded, storage position toward its unfolded, operative position, and to cushion the table assembly during movement toward its unfolded, operative position. One or more torsion bars are interconnected with at least one of the table sections, and torque is imparted to the torsion bars as the table section is moved so as to place the table assembly in its unfolded, operative position. Energy is thus stored in the torsion bars when the table assembly is in its unfolded, operative position, and assists in moving the table assembly toward its folded, storage position when an upward force is exerted on either table section. In a preferred form, the leg arrangement includes at least one upper cross-member which is pivotable relative to the table top, and the torsion bar is mounted within an internal passage defined by the upper cross-member. In addition, at least one extendible and retractable pneumatic cylinder assembly is interconnected between one of the leg arrangements and the hinge arrangement. The pneumatic cylinder assembly is oriented such that movement of the table assembly to its folded, storage position functions to move the cylinder assembly to an extended position, and movement of the table assembly to its unfolded, operative position functions to move the cylinder assembly to a retracted position. The cylinder assembly is operable to control the rate of lowering of the table sections as the table assembly is moved to its unfolded, operative position, to ensure that the table sections are lowered at a relatively slow, controlled speed. In addition, the cylinder assembly includes a spring for urging the cylinder assembly toward its extended position from its retracted position, to assist in raising the table sections when the table assembly is moved from its unfolded, operative position toward its folded, storage position.

In accordance with another aspect of the invention, the torsion bar system is preferably interconnected with and extends between a pair of structural apron members to which the table top is mounted. As noted above, the torsion bar is preferably received within an upper cross-member defined by the leg arrangement of a table section. The upper cross-member of the leg arrangement is pivotably mounted between the structural apron members by means of a pair of pivot hubs, one of which is mounted to each of the structural apron members. In one form, each pivot hub includes a mounting flange member adapted to be secured to the structural apron member, and a sleeve connected to the mounting flange member and extending therefrom toward the opposite structural apron member. One of a pair of ends of the upper cross-member is received within each sleeve, for pivotably mounting the leg arrangement to and between the structural apron members. A torsion bar retainer is mounted to one of the sleeves, and the torsion bar is non-rotatably engaged with the torsion bar retainer. At a location spaced from the torsion bar retainer, the torsion bar is engaged with a torsion bar driver mounted to the upper cross-member, such that pivoting movement of the upper cross-member caused by movement of the leg arrangement functions to impart torque to the torsion bar as the table section is lowered. With this arrangement, the torsion bar assist mechanism is essentially incorporated into the leg arrangement and interconnected with the structural apron members, for providing an efficient torsion bar mounting arrangement and for concealing the torsion bar system.

In accordance with another aspect of the invention, a folding sectional table incorporates a pneumatic cylinder assist and cushioning arrangement. The table sections are interconnected by means of at least one pair of hinge members which are pivotably interconnected with each other via a pivot pin. A foldable leg arrangement is located adjacent at least one of the hinge members, and an extendible and retractable pneumatic cylinder assembly is interconnected between the leg arrangement and the hinge arrangement. In a preferred form, the cylinder assembly is pivotably mounted at a first end to the hinge arrangement and at a second end to the leg arrangement. The first end of the pneumatic cylinder assembly is preferably pivotably mounted at a location coincident with the pivot axis defined by the pivot pin which pivotably interconnects the pivot members. The second end of the pneumatic cylinder assembly is pivotably interconnected with the leg arrangement. In embodiments incorporating more than one pair of hinge members, a pneumatic cylinder assembly is preferably interconnected with each pair of hinge members. The pneumatic cylinder assemblies are operable to cushion movement of the table assembly as the table assembly is moved toward its unfolded, operative position. The cylinder assemblies are especially beneficial in relatively heavy table assemblies, such as table assemblies with table tops having a relatively long length or in table assemblies incorporating fixed seating structures.

The invention further contemplates a latch arrangement for a folding sectional table assembly. The latch arrangement includes a latch member mounted to one of the table sections and a catch member mounted to the other table section. The latch member is movable between an engaged position in which the latch member engages the catch member to maintain the table assembly in its inoperative, folded position, and a disengaged position in which the latch member is disengaged from the catch member to enable the table assembly to be moved away from its folded, storage position toward its unfolded, operative position. The latch member is preferably pivotably mounted to a cross-member located adjacent the underside of the table top, such as a cross-member associated with a leg arrangement. Movement of the latch member from its engaged position toward its disengaged position is caused by operation of an actuator member, which preferably includes an actuator area located adjacent each of a pair of opposite sides defined by the table top so as to enable operation of the latch arrangement from either side of the table assembly, without reaching between the folded table sections. The actuator member is preferably in the form of a rod pivotably mounted to and between the structural apron members at a location offset from the pivotable mounting of the latch member. The rod includes first and second engagement areas located one adjacent each of the structural apron members, with an intermediate actuating section therebetween which is engageable with the latch member. The intermediate actuating section is received within a slot defined by the latch member and is offset from the actuator areas, such that pivoting movement of the actuator member causes engagement of the actuator section with a wall of the latch member defining the slot, to move the actuator member away from its engaged position. In a preferred form, a spring is interconnected with the latch member for biasing the latch member toward its engaged position, such that the latch member automatically engages the catch member as the table assembly is moved to its folded, storage position.

The various features of the invention can be employed separately to provide advantages in operation over the prior art. In a particularly preferred form, however, the various features are combined so as to provide a table assembly with a umber of advantages over the prior art.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 10 is a partial section view taken along line 10—10 of FIG. 7;

FIG. 11 is a view similar to FIG. 7, showing operation of a locking bar for selectively retaining the table assembly in the unfolded, operative position;

DETAILED DESCRIPTION OF THE INVENTION

Figure 1:
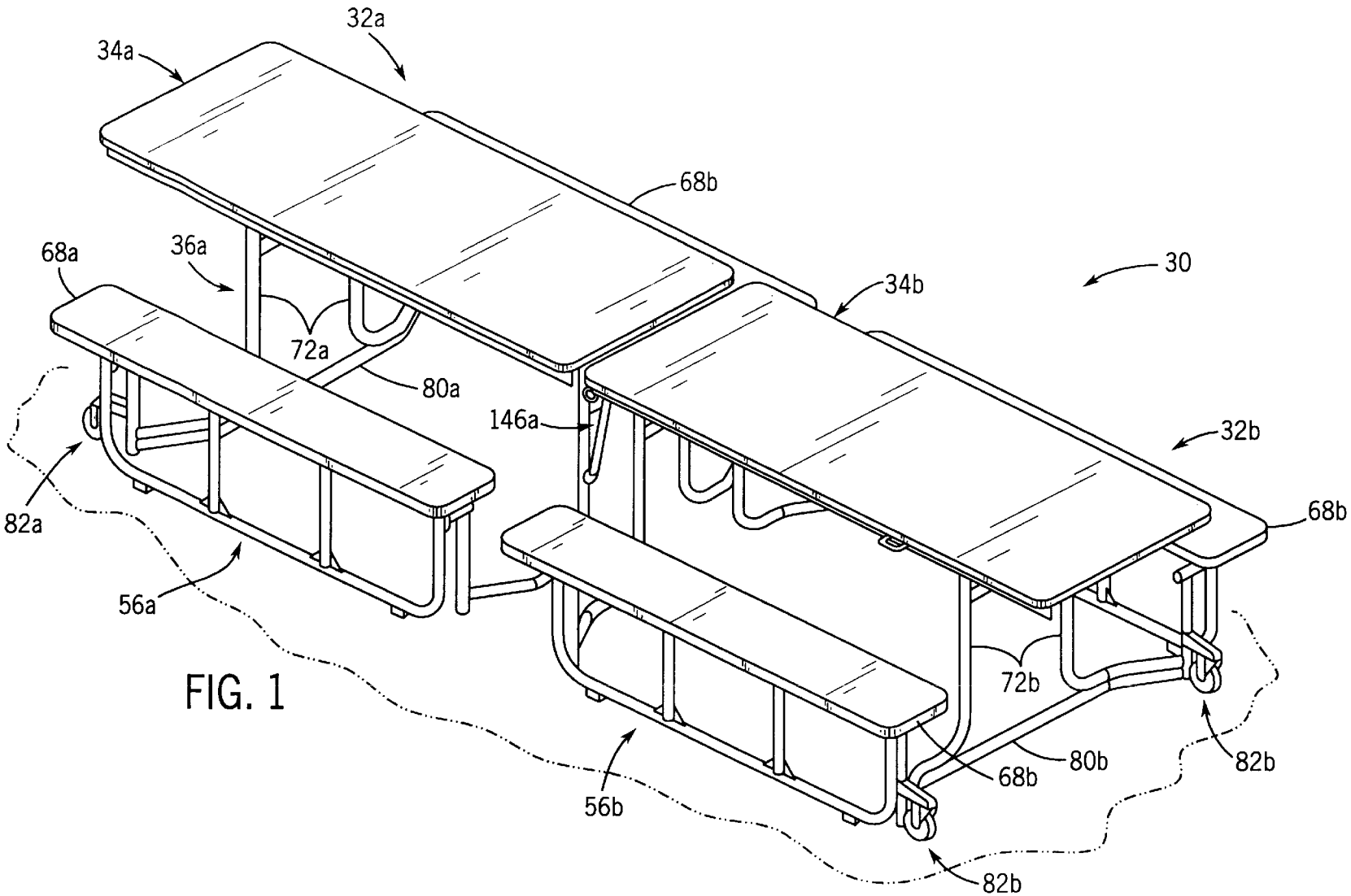
FIG. 1 is an isometric view of a folding sectional table constructed according to the invention, showing the table assembly in an unfolded, operative position.
Figure 2:
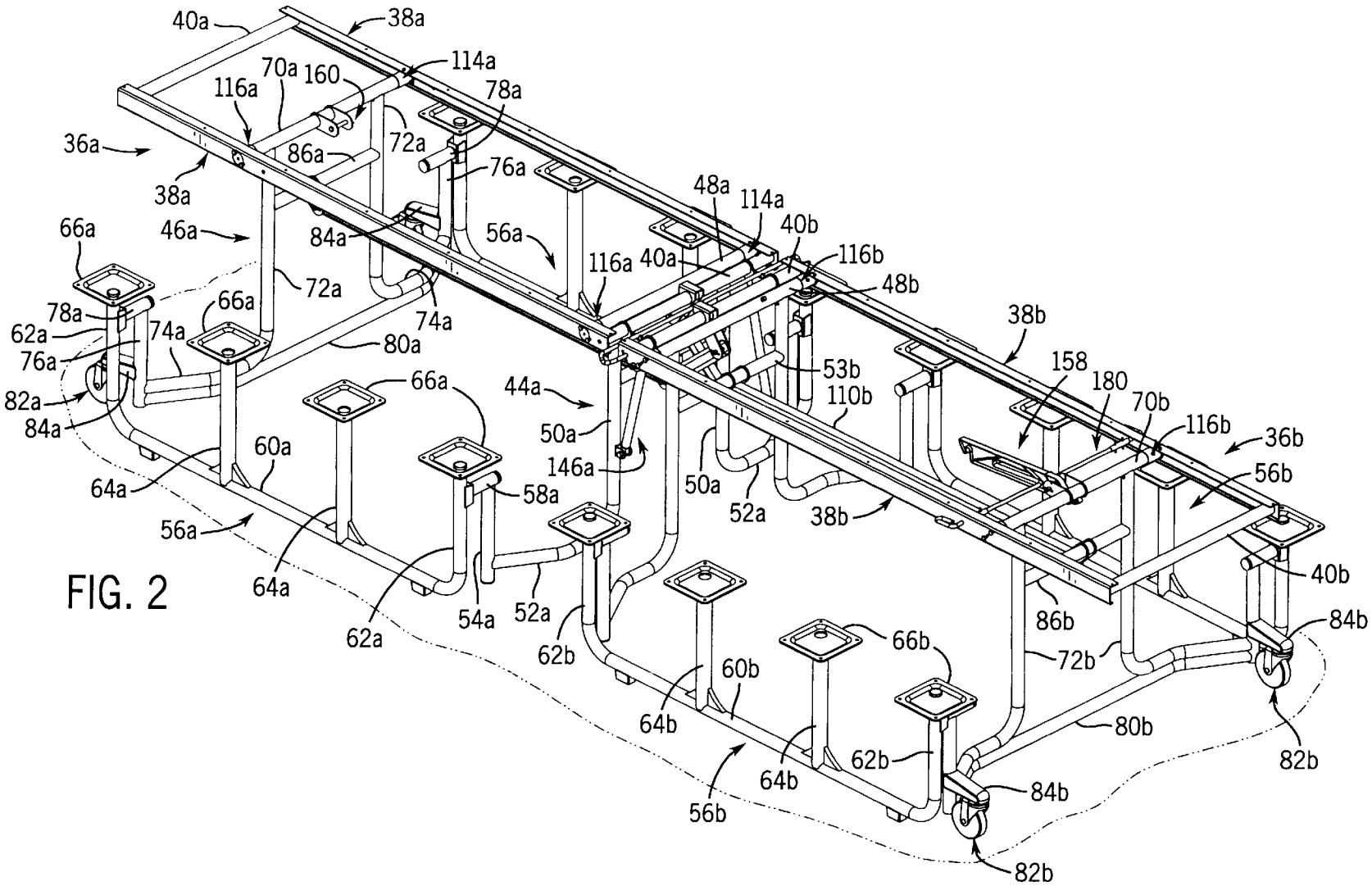
FIG. 2 is an isometric view of the frame of the table assembly of FIG. 1 in an unfolded, operative position.

Referring to FIGS. 1 and 2, a sectional table assembly 30 constructed according to the invention generally includes a pair of pivotable table sections 32*a* and 32*b*, which are essentially mirror images of each other and are pivotably interconnected with each other in a manner to be explained for movement between a folded, storage position and an unfolded, operative position. Except as described below, table sections 32*a* and 32*b* are identical in construction and contain identical components, and like reference characters will be used to describe the components of table sections 32*a* and 32*b*, with the modifier "a" and "b" being used to refer to components associated with table sections 32*a* and 32*b*, respectively. Except as expressly set forth hereafter, the description of table section 32*a* applies equally to table section 32*b*, and vice versa.

Figure 3:
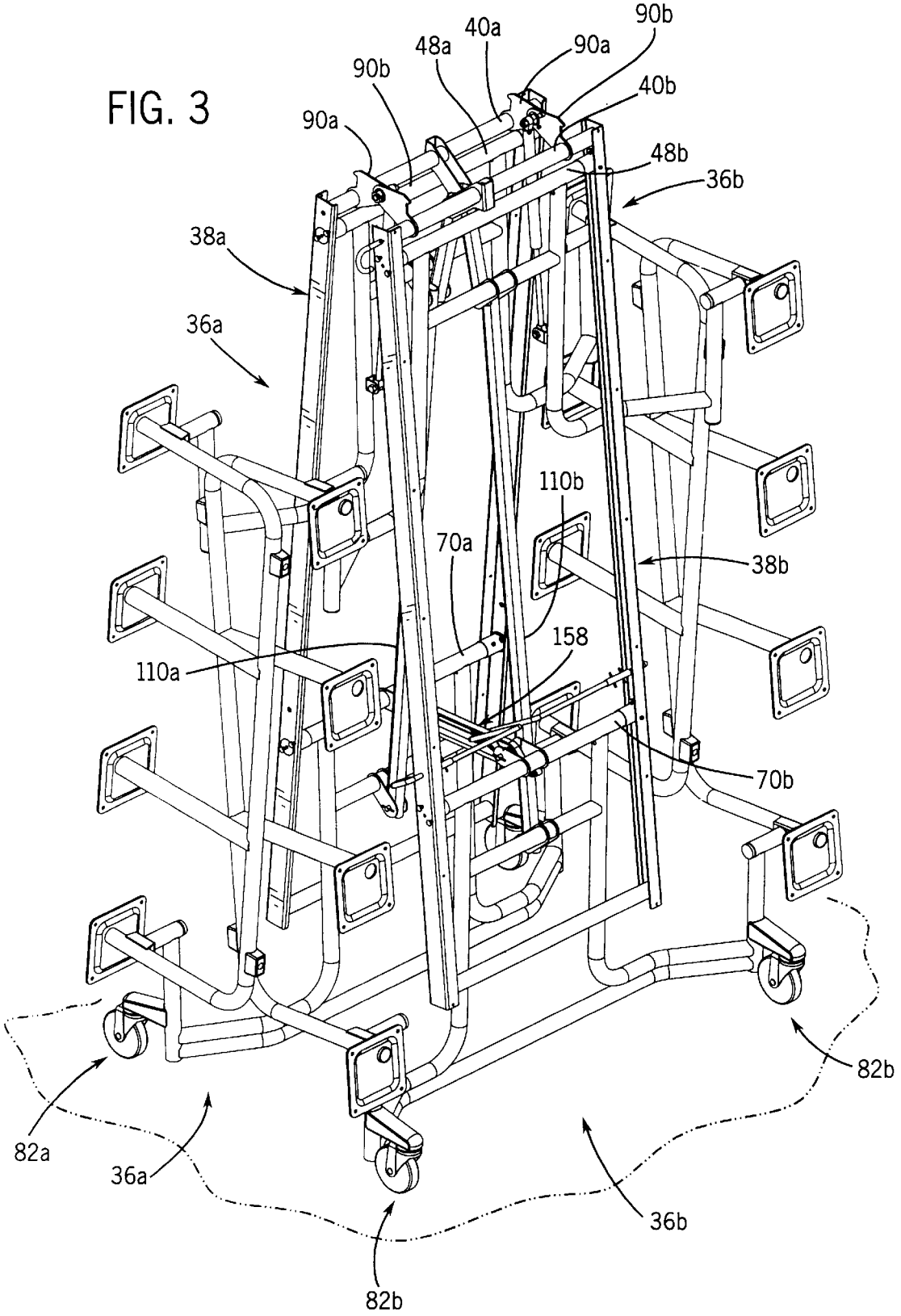
FIG. 3 is a view similar to FIG. 2, showing the frame in a folded, storage position.
Figure 4:
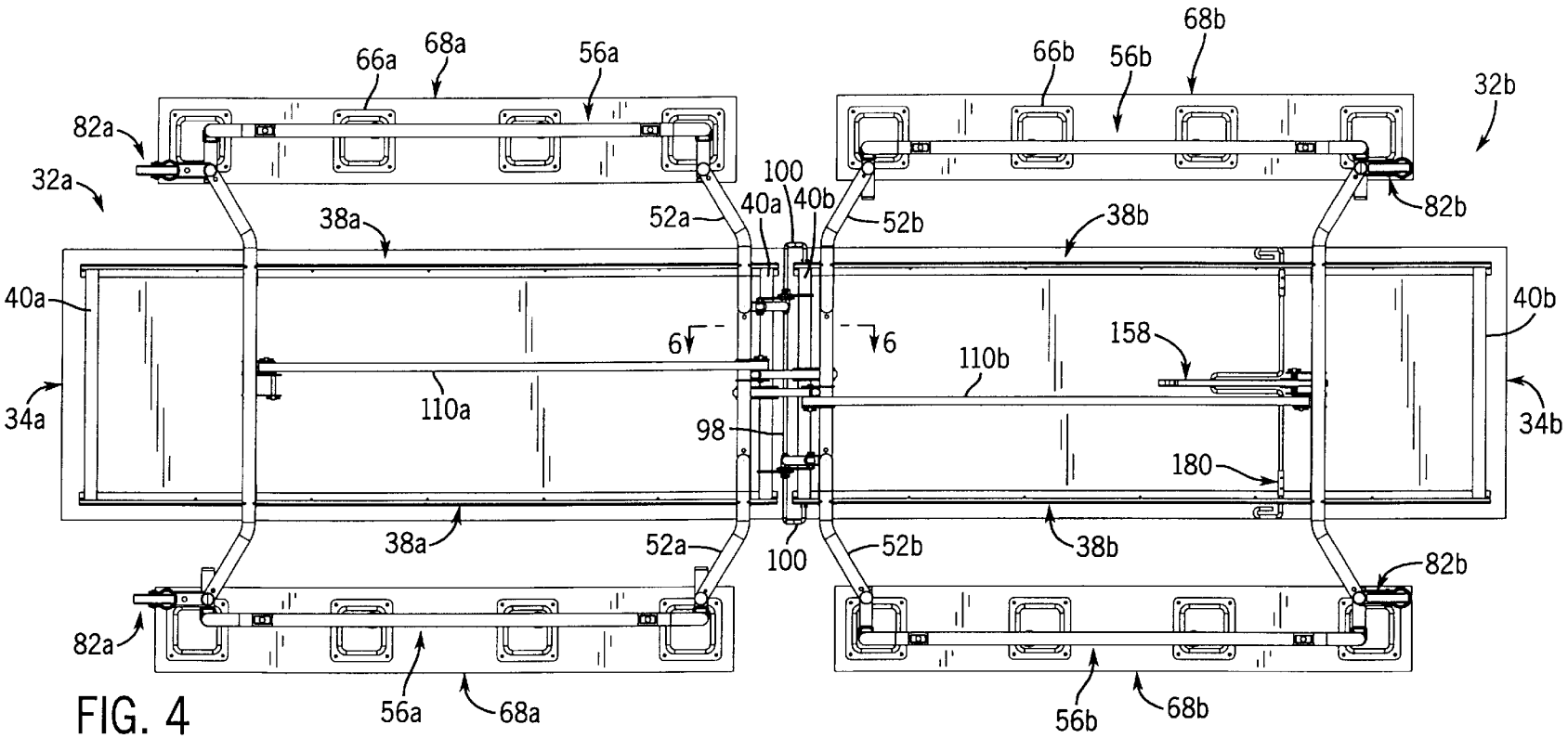
FIG. 4 is a bottom plan view of the table assembly of FIG. 1.
Figure 5:
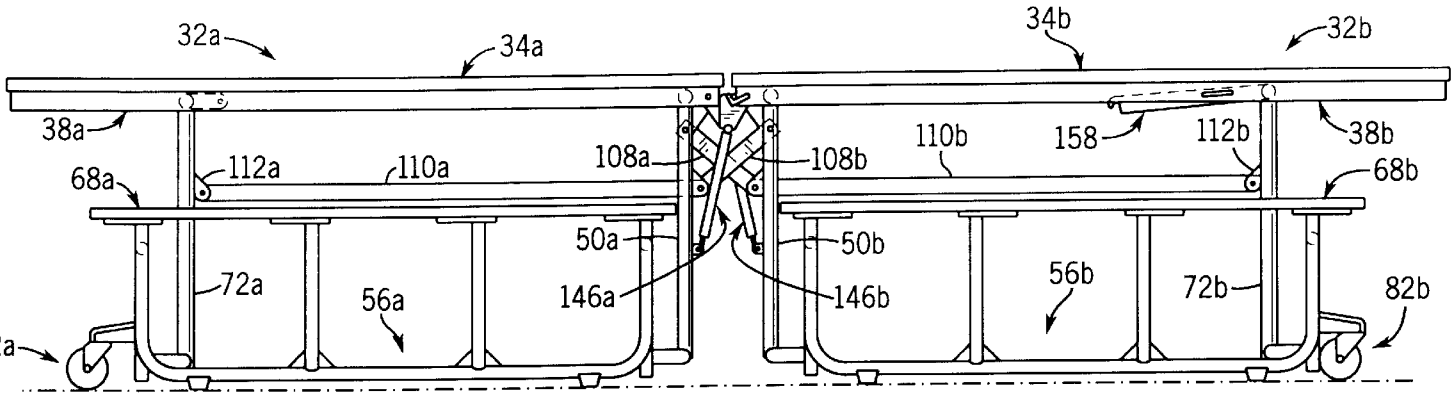
FIG. 5 is a side elevation view of the table assembly of FIG. 1.

Table section 32*a* includes a table top 34*a* and a frame assembly 36*a*. Table top 34*a* is of conventional construction, and is secured to a pair of spaced, parallel structural apron members 38*a* forming a part of frame assembly 36*a*. Frame assemblies 36*a* and 36*b* are pivotably interconnected with each other for movement between an unfolded, operative position as shown in FIG. 2, and a folded, storage position as shown in FIG. 3.

In addition to apron members 38*a*, frame assembly 36*a* includes a pair of structural cross-members 40*a* extending between the ends of apron members 38*a*. Cross-members 40*a* are rigidly mounted to apron members 38*a* in any satisfactory manner such as by welding, to form a rigid rectangular structure to which the underside of table top 34*a* is secured.

Frame assembly 36*a* further includes an inner leg assembly 44*a* and an outer leg assembly 46*a*. Inner leg assembly 44*a* includes an upper horizontal tubular member 48*a* and a pair of depending leg members 50*a*, each of which is mounted at its upper end to upper horizontal tubular member 48*a*. Each leg member 50 includes an outwardly extending horizontal base section 52*a* which extends outwardly beyond the sides of table top 34*a*, and an intermediate cross-member 53*a* which extends between and is interconnected at its ends with leg members 72*a*. An upstanding seat support member 54*a* is secured to the outer end of base section 52*a*, and is interconnected with a seat frame 56*a* by means of a horizontal connector member 58*a*. Seat frame 56*a* includes a lower base member 60*a* interconnected with end uprights 62*a* and intermediate uprights 64*a*. A seat support plate 66*a* is mounted to the upper end of each of uprights 62*a* and 64*a*, and a seat member, such as a bench 68*a*, is interconnected with seat support plates 66*a*. Alternatively, it is understood that separate seats may be mounted to each of seat support plates 66*a* in place of bench 68*a*, when individual seats are desired.

Outer leg assembly 46*a* is constructed similarly to inner leg assembly 44*a*, including an upper horizontal tubular member 70*a* and a pair of depending leg members 72*a*. A base section 74*a* is interconnected with and extends outwardly from the lower end of each depending leg member 72*a*. A seat support member 76*a* is mounted to the outer end of each base section 74*a*, extending upwardly therefrom and interconnected with seat frame 56*a* via a connector member 78*a*. A lower cross-brace member 80*a* extends between and interconnects base sections 74*a*, and is connected at each end to seat support member 76*a* below base section 74*a*. A caster assembly 82*a* is interconnected with each seat support member 76*a* via a caster mounting bracket 84*a*. An intermediate cross-member 86*a* extends between and is interconnected at its ends with leg members 72*a*.

Referring to FIGS. 3 and 5–7, a pair of hinge plates 90*a* are rigidly mounted to the inner one of cross-members 40*a* of frame assembly 36*a*. Similarly, a pair of hinge plates 90*b* are rigidly mounted to the inner one of cross-members 40*b* of frame assembly 36*b*. Each hinge plate 90*a* is located adjacent one of hinge plates 90*b*, with each such set of hinge plates being located adjacent one side of table assembly 30. A hinge pin 94, in the form of a bolt or the like, extends through aligned openings in hinge plates 90*a* and 90*b*. Hinge pins 94 define a pivot axis about which frame assembly 36*a* and 36*b* are pivotable relative to each other, for providing pivoting movement between the unfolded, operative position of FIGS. 1, 2, 4 and 5, and the folded, storage position of FIGS. 3 and 8.

Figure 7:
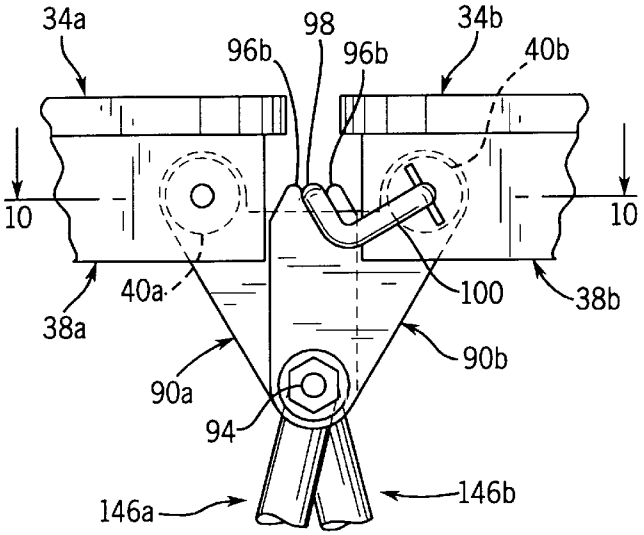
FIG. 7 is an enlarged partial side elevation view of a hinge arrangement interconnecting the table sections of the folding table assembly of FIG. 1.

Referring to FIG. 7, hinge plate 90*a* includes an upper edge from which a tab 96*a* extends upwardly. Similarly, hinge plate 90*b* defines an upper edge from which a tab 96*b* extends upwardly. When table assembly 30 is in its unfolded, operative position, tabs 96*a* and 96*b* are spaced slightly apart from each other. A locking rod 98 is pivotably interconnected with apron members 38*b* of table section 32*b* via end mounting sections 100. When table assembly 30 is in its unfolded, operative position, locking rod 98 is located in the space between tabs 96*a* and 96*b*, for preventing inadvertent movement of frame assemblies 36*a* and 36*b* away from the unfolded, operative position in the event an inadvertent upward force is applied to either frame assembly. As shown in FIG. 10, each end mounting section 100 includes an inwardly extending mounting shaft section 102 which extends through an opening in one of apron members 38*b*, for providing pivoting movement of locking rod 98 about a pivot axis defined by mounting shaft sections 102. As shown in FIG. 11, locking rod 98 is movable out of the space between tabs 96*a* and 96*b*, for allowing relative movement between hinge plates 90*a* and 90*b* in order to enable table sections 32*a* and 32*b* to be moved away from the unfolded, operative position toward the folded, storage position.

Figure 6:
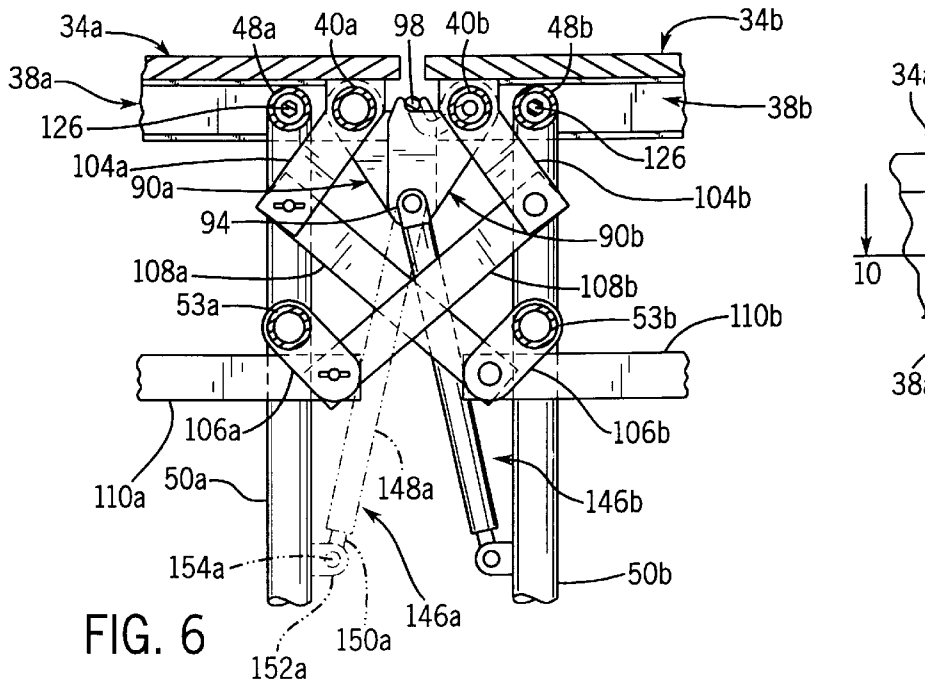
FIG. 6 is a partial section view taken along line 6—6 of FIG. 4.

As shown in FIG. 6, upper bars 104*a*, 104*b* are rigidly mounted to cross-members 40*a*, 40*b*, respectively. Lower bars 106*a*, 106*b* are rigidly mounted to intermediate cross-members 53*a*, 53*b*, respectively. A link 108*a* is pivotably mounted at an upper end to upper bar 104*a*, and is pivotably mounted at a lower end to lower bar 106*b*. Similarly, a link 108*b* is pivotably mounted at an upper end to upper bar 104*b* and at a lower end to lower bar 106*a*. A tie bar 110*a* is pivotably mounted at an inner end to lower bar 106*a* and link 108*b*, and is pivotably mounted at an outer end to a tab 112*a* (FIG. 5) secured to intermediate cross-member 86*a*. Similarly, tie bar 110*b* is pivotably mounted at an inner end to lower bar 106*b* and link 108*a*, and at an outer end to a tab 112*b* secured to intermediate cross-member 86*b*.

Referring to FIG. 2, upper horizontal tubular member 48*a* of inner leg assembly 44*a* is interconnected with apron members 38*a* via hub assemblies 114*a*, 116*a*. Similarly, hub assemblies 114*a* and 116*a* are interposed between upper horizontal tubular member 70*a* of outer leg assembly 46*a* and apron members 38*a*.

Figure 13:
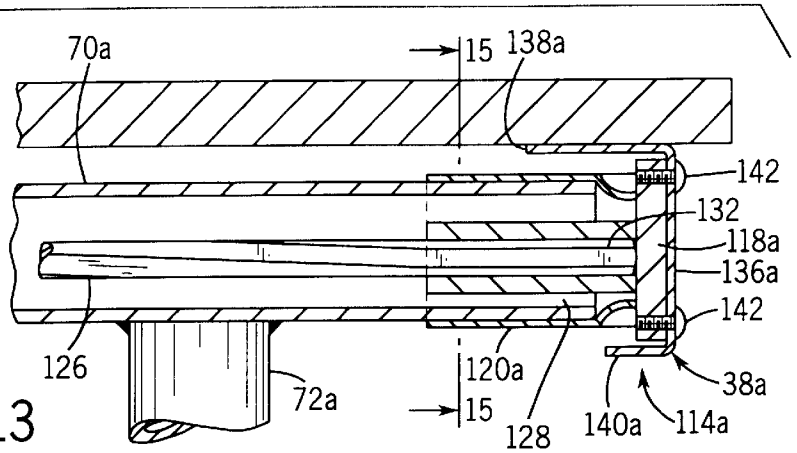
FIG. 13 is a partial section view taken along line 13—13 of FIG. 12.
Figure 15:
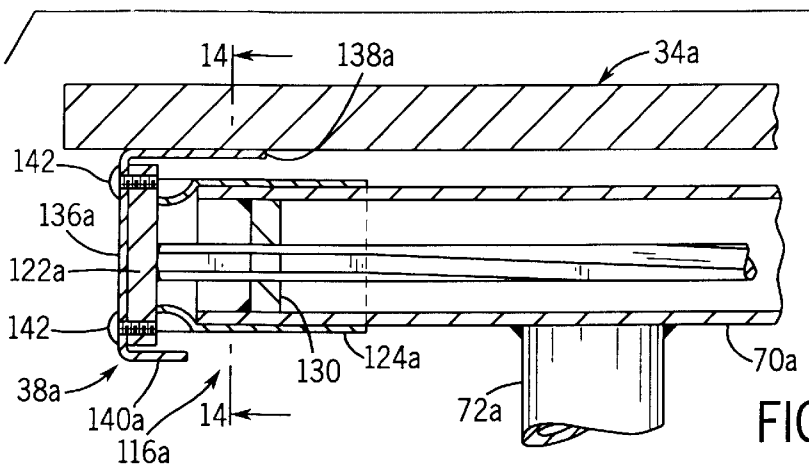
FIG. 15 is a partial section view taken along line 15—15 of FIG. 13.
Figure 15:
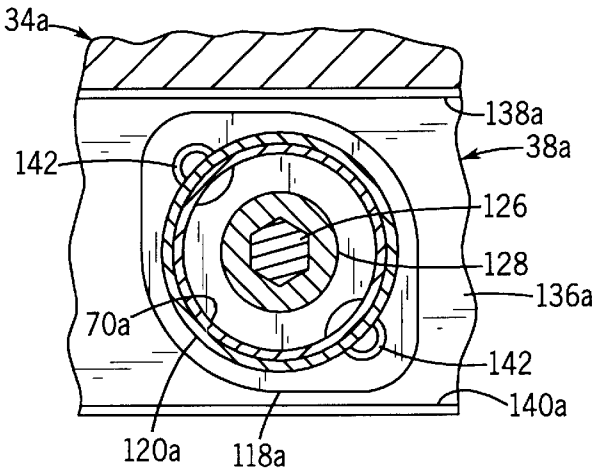
Figure 14:
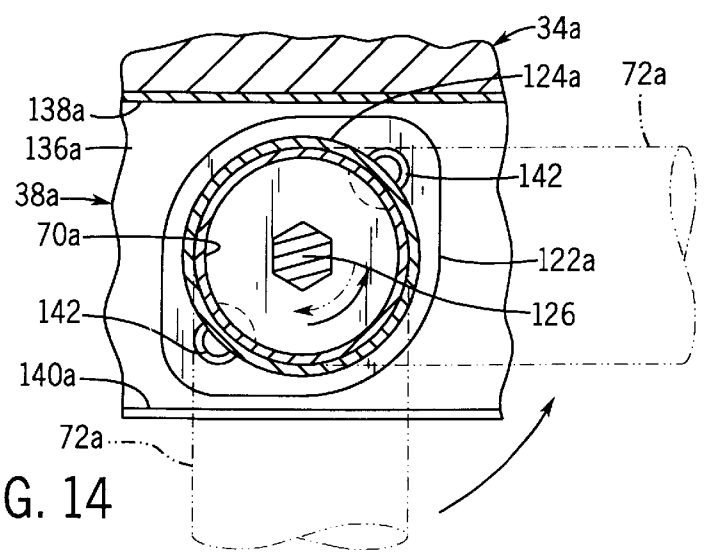
FIG. 14 is a partial section view taken along line 14—14 of FIG. 13.

As shown in FIGS. 13–15, hub assembly 114*a* includes a mounting flange member 118*a* and a sleeve 120*a* secured to mounting flange member 118*a*. Similarly, hub assembly 116*a* includes a mounting flange member 122*a* and a sleeve 124*a* secured thereto. One end of upper horizontal tubular member 70*a* is received within sleeve 120*a*, and the opposite end of upper horizontal tubular member 70*a* is received within sleeve 124*a*. Upper horizontal tubular member 70*a* is pivotable relative to sleeves 120*a* and 124*a*, so as to provide pivoting movement of outer leg assembly 46*a* relative to apron members 38*a* and table top 34*a*. Upper horizontal tubular member 48*a* of inner leg assembly 44*a* is mounted to hub assemblies 114*a* and 116*a* at the inner ends of apron members 38*a* in the same manner, for providing pivoting movement of inner leg assembly 44*a* relative to apron members 38*a* and table top 34*a*.

Referring to FIG. 13, upper horizontal tubular member 70*a* defines an internal passage within which a torsion bar 126 is received. A torsion bar retainer 128 is mounted to mounting flange member 118*a*, extending inwardly therefrom within the passage defined by sleeve 120*a*. A torsion bar driver 130 is mounted within the internal passage defined by upper horizontal tubular member 70*a* in the vicinity of sleeve 124*a*, opposite torsion bar retainer 128. Torsion bar 126 defines a non-circular cross-section, such as a hexagonal cross-section as illustrated, and torsion bar retainer 128 includes a mating non-circular passage 132 within which one end of torsion bar 126 is received, for non-rotatably mounting torsion bar 126 to hub assembly 114*a*. Torsion bar driver 130 similarly defines an opening having a non-circular cross-section corresponding to that of torsion bar 126. With this arrangement, pivoting movement of outer leg assembly 46*a* relative to structural apron members 38*a* upon movement of table sections 32*a*, 32*b* toward the unfolded, operative position functions to twist torsion bar 126 so as to store energy, which assists in raising table sections 32*a*, 32*b* when moving table sections 32*a*, 32*b* away from the unfolded, operative position toward the folded, storage position.

Each apron member 38*a* defines a web 136*a*, an upper flange 138*a* and a lower flange 140*a*. Mounting flange 118*a* of hub assembly 114*a* defines a pair of threaded passages, and threaded fasteners such as screws 142 extend through openings in apron web 136*a* and into the threaded passages of mounting flange member 118*a* for securing hub assembly 114*a* in position relative to apron member 38*a*. Similarly, mounting flange member 122*a* of hub assembly 116*a* includes a pair of threaded passages, and threaded fasteners such as screws 142 extend through openings in web 136*a* and into the threaded passages of mounting flange member 122*a* for securing hub assembly 116*a* in position relative to apron member 38*a*. With this arrangement, the presence of a torsion bar assist mechanism is concealed between apron members 38*a*, for simplifying assembly and for providing a more aesthetically desirable torsion bar mounting arrangement.

Referring to FIG. 6, a pneumatic cylinder assembly 146*a* is interconnected between one of depending leg members 50*a* and one set of hinge plates 90*a*, 90*b*. Pneumatic cylinder assembly 146*a* includes a cylinder 148*a* and a rod 150*a*. Cylinder 148*a* is pivotably interconnected with hinge plates 90*a*, 90*b* at hinge pin 94, and rod 150*a* is pivotably mounted to leg member 50*a* by a tab 152*a* and a pivot pin 154*a*. Similarly, cylinder assembly 146*b* is interconnected in the same manner between one of depending leg members 50*b* and the other set of hinge plates 90*a*, 90*b*. Cylinder assemblies 146*a*, 146*b* are pneumatic cushioning cylinder assemblies which are spring biased toward an extended position, such as is available from Suspa of Grand Rapids, Mich. under Part Nos. 37-3351, 37-3352, 37-3353, 37-3354 and 37-3355, selected according to the size and weight of the components of table assembly 30.

Figure 8:
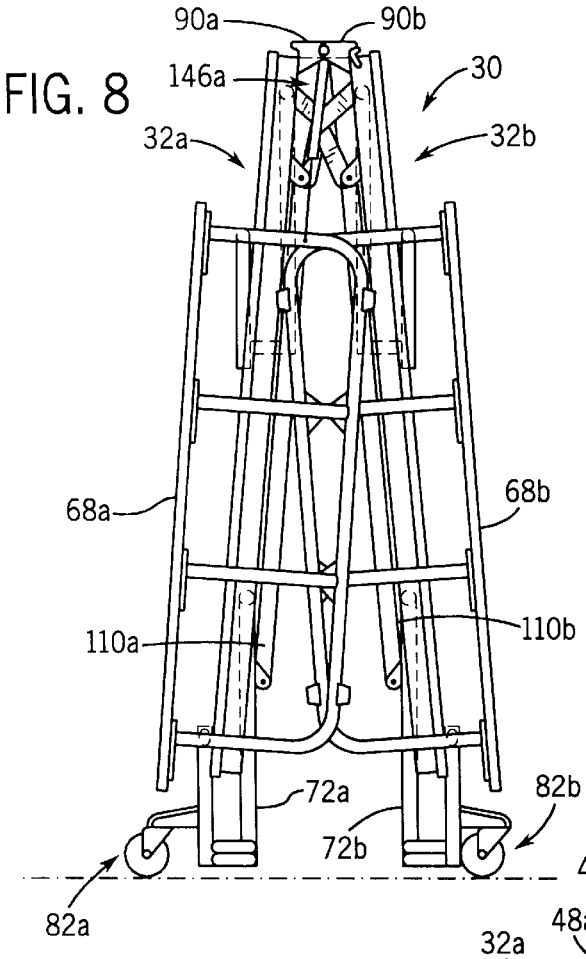
FIG. 8 is a side elevation view similar to FIG. 5, showing the table assembly in a fold, storage position.
Figure 9:
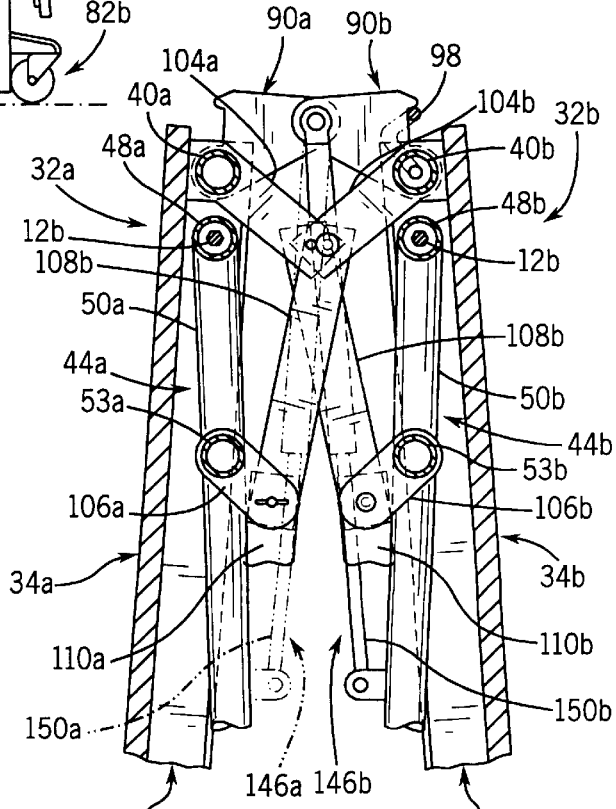
FIG. 9 is an enlarged partial section view of the hinge arrangement of FIG. 7 in combination with a linkage arrangement, showing the table assembly in the folded, storage position.
Figure 12:
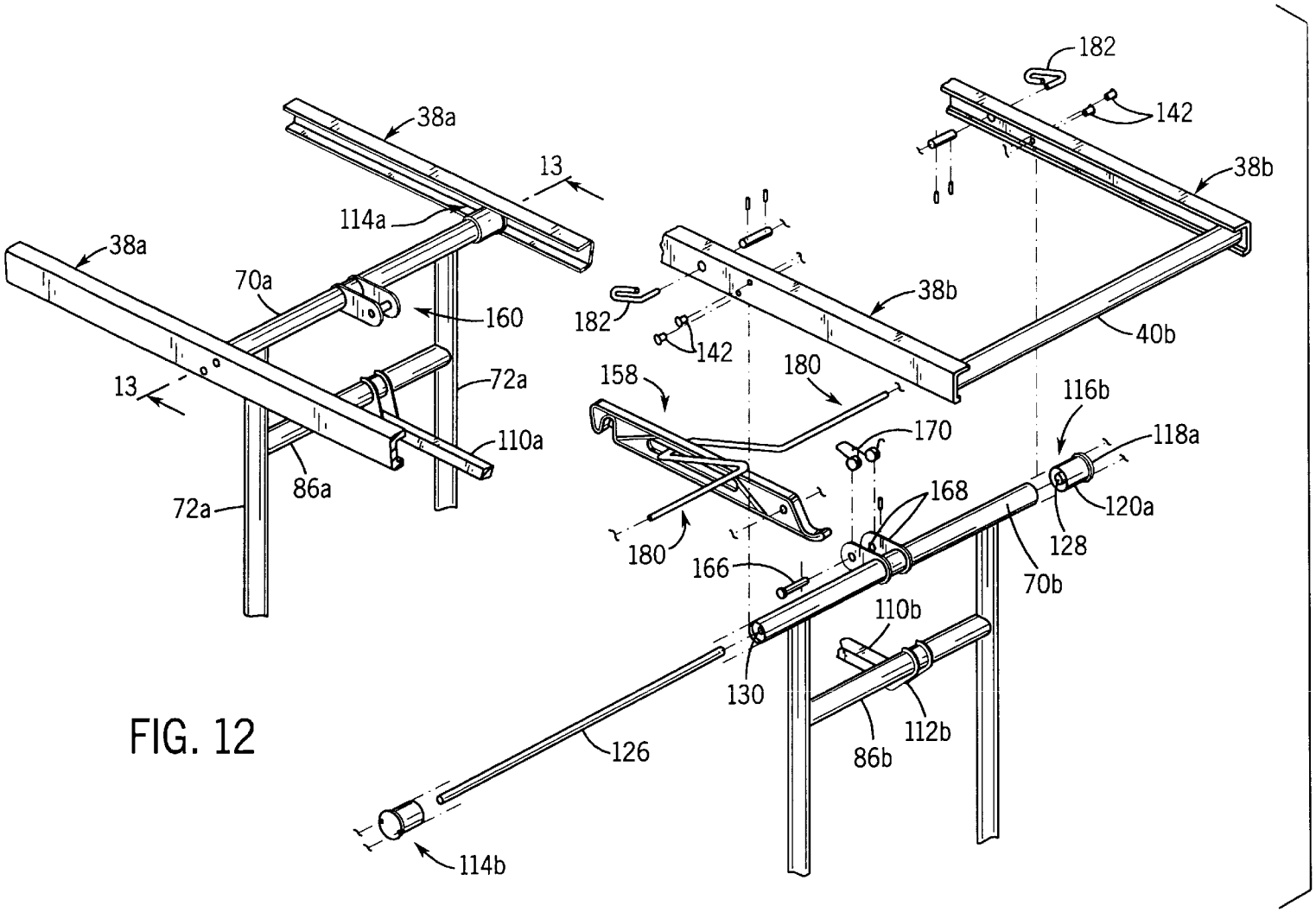
FIG. 12 is an exploded partial isometric view showing the torsion bar mounting arrangement and the latch arrangement incorporated into the table assembly of FIG. 1.
Figure 16:
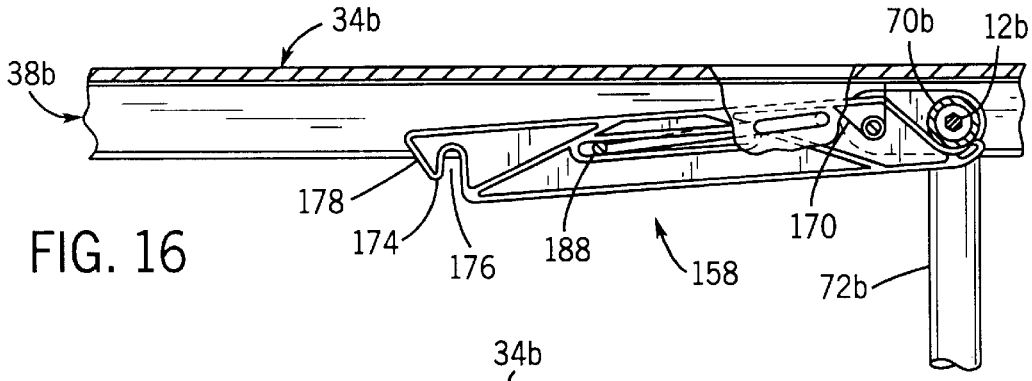
FIG. 16 is a partial side elevation view illustrating the latch member incorporated into the table assembly of FIG. 1.
Figure 17:
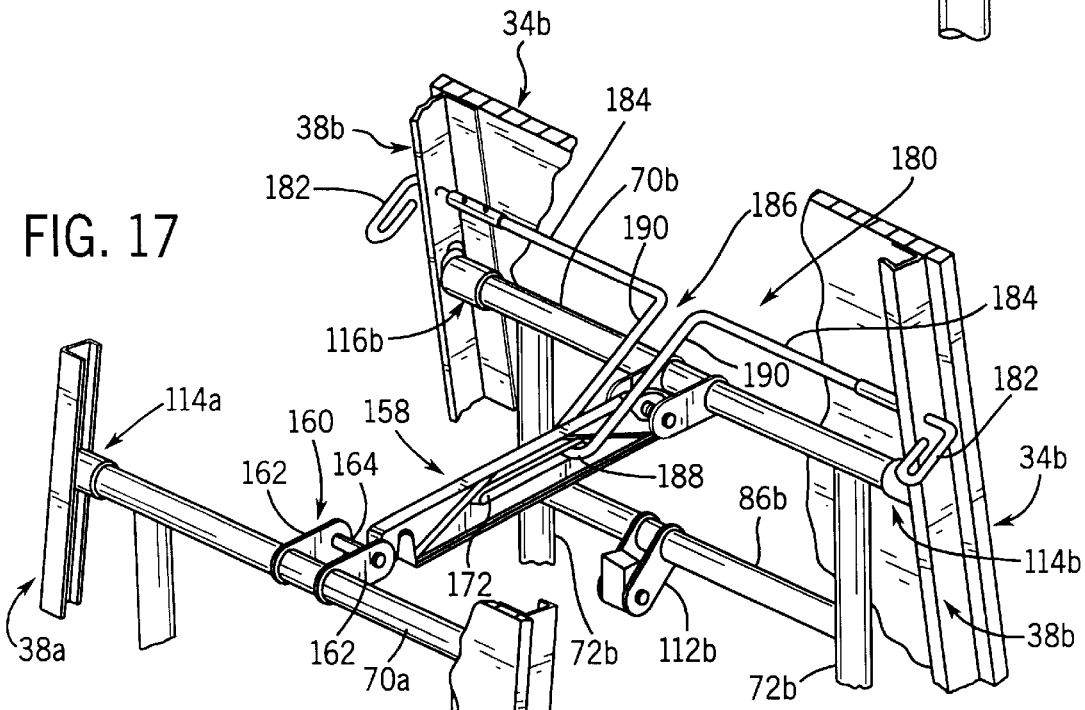
FIG. 17 is a partial isometric view illustrating the latch member of FIG. 16 in combination with a catch member.
Figure 18:
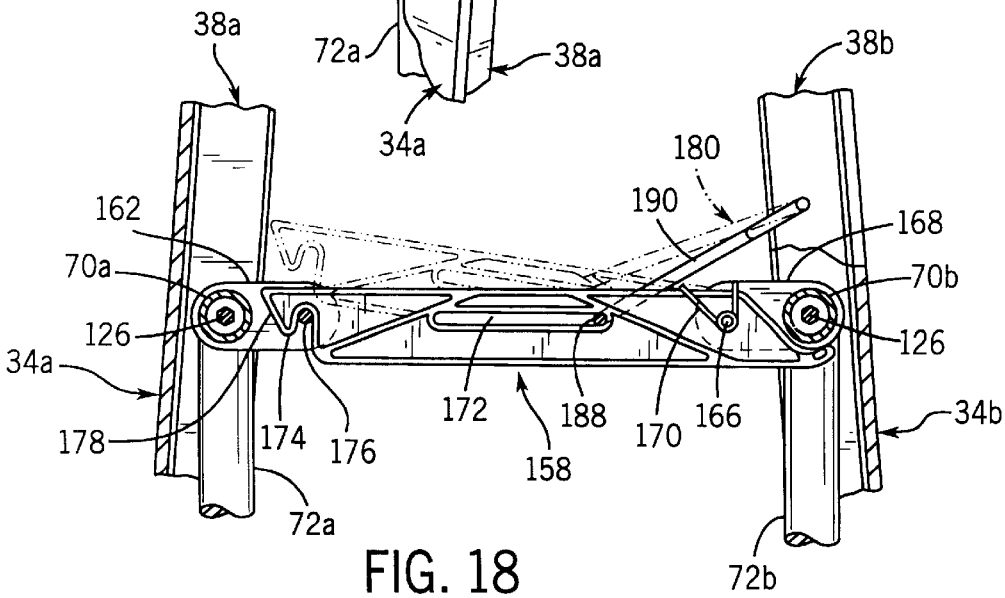
FIG. 18 is a partial section view showing operation of the latch member and catch member of FIG. 17 for maintaining the table assembly in the folded, storage position.

FIGS. 16–18 illustrate a latch arrangement for selectively maintaining table assembly 30 in its folded, storage position of FIGS. 3 and 8. Generally, the latch arrangement includes a latch member 158 and a catch member 160. Catch member 160 includes a pair of tabs 162 rigidly mounted to upper horizontal tubular member 70*a* of frame assembly 36*a*. A catch rod 164 extends between and is mounted at its ends to tabs 162.

Latch member 158 is pivotably mounted at an inner end to a pivot pin 166 which extends between a pair of tabs 168 rigidly fixed to upper horizontal tubular member 70*b* of frame assembly 36*b*. Pivot pin 166 extends through a torsion spring 170, which is interconnected between one of tabs 168 and latch member 158 for biasing latch member 158 downwardly, or counterclockwise with reference to FIGS. 16–18. Latch member 158 includes an axially extending slot 172, and a hook 174 at its outer end defining a notch 176. A ramped end edge 178 is located outwardly of hook 174.

An actuator member, shown generally at 180, is interconnected between actuator member 158 and apron members 38*b* for pivoting actuator member 158 upwardly or counterclockwise about pivot pin 166. Actuator member 180 includes a pair of end actuator areas 182, each of which is located outwardly of one of apron members 38*b*. A mounting section 184 extends inwardly from each end actuator area 182 through an opening formed in each apron member 38*b* for providing pivoting movement of actuator member 180 relative to apron members 38*b*. Actuator member 180 further includes a central area 186 including an actuator section 188, which extends parallel to mounting sections 184, and a pair of connector sections 190 which extend between actuator section 188 and mounting sections 184. With this construction, actuator section 188 is laterally offset from the pivot axis of actuator member 180 as defined by the longitudinal axes of mounting sections 184.

Actuator section 188 is disposed within slot 172 of latch member 158. Upon manual engagement of either of end actuator areas 182 and manipulation thereof so as pivot actuator member 180 in a clockwise direction as shown in phantom in FIG. 18, actuator section 188 of actuator member 180 engages the upper wall of slot 172 for moving latch member 158 in a clockwise direction about pivot pin 166, to a position in which latch member 158 is disengaged from catch rod 164. Releasing end engagement areas 182 of actuator member 180 causes counterclockwise pivoting movement of latch member 158 and actuator member 180 under the influence of torsion spring 170.

In operation, table assembly 30 functions as follows. When table assembly is in its folded, storage position, the user manipulates end actuator areas 182 of actuator member 180 to disengage latch member 158 from catch rod 164 as described above. The user than exerts a downward force on either or both of table sections 32*a* or 32*b*, which causes table sections 32*a* and 32*b* to pivot about pivot pins 94 away from the folded, storage position. This movement causes caster assemblies 82*a*, 82*b* to move outwardly away from each other, and table sections 32*a*, 32*b* are lowered toward the floor or other supporting surface. During such downward movement of table sections 32*a*, 32*b*, tie bars 110*a*, 110*b* function to bring inner leg assemblies 44*a*, 44*b* downwardly and to maintain a parallel relationship between inner leg assemblies 44*a*, 44*b* and outer leg assemblies 46*a*, 46*b*, respectively. During such downward movement of table sections 32*a*, 32*b*, torsion is applied to torsion bars 126 by torsion bar drivers 130, to store energy in torsion bars 126 tending to resist such downward movement. However, the weight of the components of table sections 32*a*, 32*b* overcomes any such resistance, such that table sections 32*a*, 32*b* continue to be lowered toward the floor.

As table sections 32*a*, 32*b* approach the fully lowered position of FIG. 2, pneumatic cylinder assemblies 146*a*, 146*b* function to cushion such downward movement of table sections 32*a*, 32*b* by the cushioning properties of cylinder assemblies 146*a*, 146*b*, in order to prevent the rapid downward movement of table sections 32*a*, 32*b* which may otherwise occur. Cylinder assemblies 146*a*, 146*b* function to gradually lower table sections 32*a*, 32*b* by gravity or with the assistance of an operator, although the cushioning properties of cylinder assemblies 146*a*, 146*b* prevent movement beyond a predetermined rate. As table sections 32*a*, 32*b* are moved together, locking rod 98 is received between tabs 96 for maintaining table sections 32*a*, 32*b* in the unfolded, operative position of FIG. 2.

When it is desired to raise table assembly 30 for folding and storage purposes, the user manipulates end mounting sections 100 of locking rod 98 to move locking rod 98 upwardly from between tabs 96, as shown in phantom in FIG. 11. The user then applies an upward force on either or both of table sections 32*a*, 32*b*, causing pivoting movement about hinge pins 94. Hydraulic cylinder assemblies 146*a*, 146*b*, which are spring biased toward an extended position, assist in such movement, as do torsion bars 126. With this arrangement, the dual assist provided by hydraulic cylinder assemblies 146*a*, 146*b* and torsion bars 126, makes it relatively easy to lift table sections 32*a*, 32*b*, to significantly ease the burden on a user in moving table sections 32*a*, 32*b* to the folded, storage position.

As table sections 32*a*, 32*b* approach the folded, storage position, angled end edge 178 of latch member 158 approaches catch rod 164 of catch member 160. Continued movement of table sections 32*a*, 32*b* together results in engagement of angled end edge 178 with catch rod 164, such that latch member 158 is pivoted in a clockwise direction until catch rod 164 clears hook 174 of latch member 158. When this occurs, latch member 158 is moved in a counterclockwise direction under the influence of torsion spring 170, to engage catch rod 164 within notch 176. With this arrangement, engagement of latch member 158 with catch member 160 functions to retain table sections 32*a*, 32*b* together in the folded, storage position.

When it is desired to subsequently move table sections 32*a*, 32*b* to the unfolded, operative position, the user manipulates end actuator areas 182 of actuator member 180, from either side of table assembly 30, so as to rotate latch member 158 clockwise and to disengage catch rod 164 from notch 176. Once table sections 32*a*, 32*b* are moved slightly apart, the user releases engagement with the end actuator area 182 and moves table sections 32*a*, 32*b* downwardly as described above.

Figure 19A:
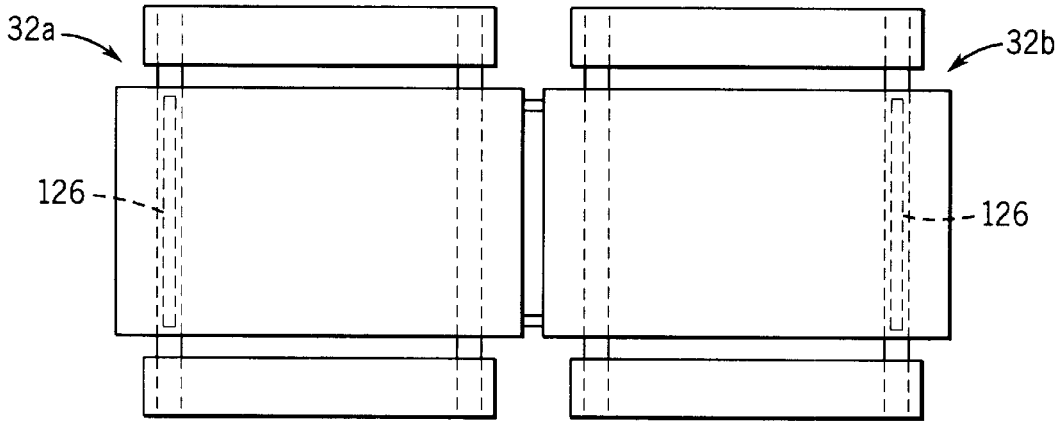
FIGS. 19*a*–19*c* are schematic top plan views illustrating different torsion bar configurations for a table assembly such as that of FIG. 1.
Figure 19B:
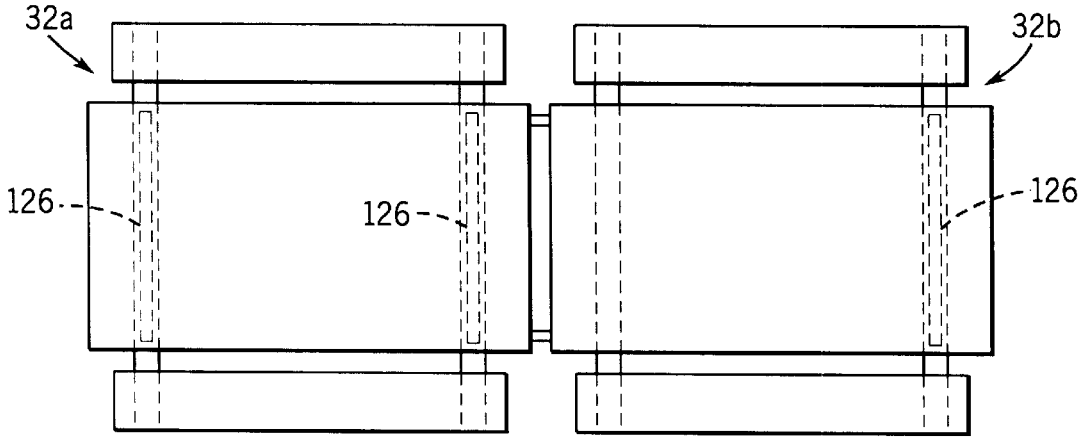
Figure 19C:
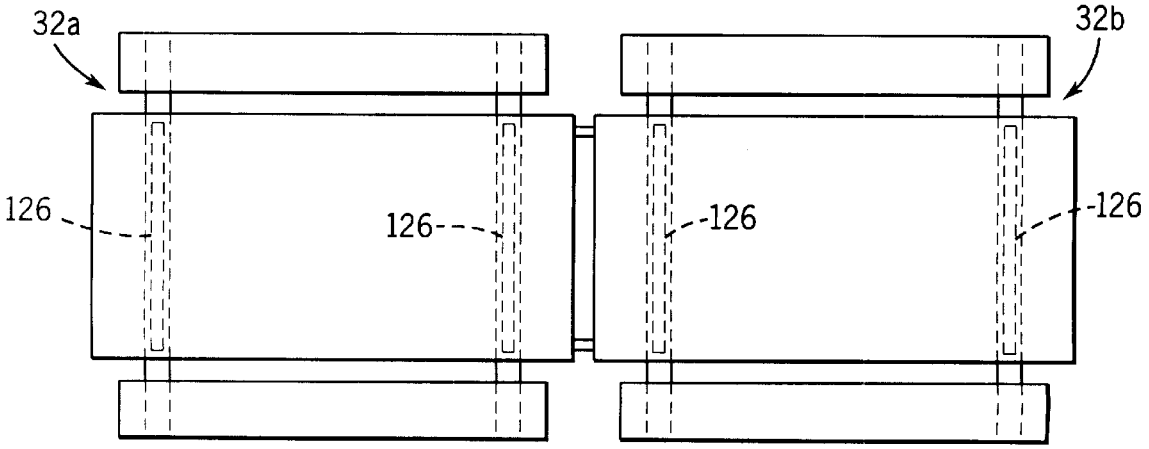

Referring to FIGS. 19*a*–19*c*, it can be appreciated that any number of torsion bars 126 may be incorporated into a table assembly. Referring to FIG. 19*a*, a table assembly 30' incorporates two torsion bars 126 and associated hub mounting arrangements, with each torsion bar 126 being associated with an outer leg assembly. FIG. 19*a* illustrates two torsion bars 126, FIG. 19*b* illustrates three torsion bars 126, and FIG. 19*c* illustrates four torsion bars 126. FIGS. 19*a*–19*c* illustrate table sections 32*a*, 32*b* schematically, and it is understood that more torsion bars 126 are used for larger table sections 32*a*, 32*b* or table sections with fixed seating, and fewer torsion bars 126 are used with smaller table sections 32*a*, 32*b* or table sections without fixed seating.

When an upper horizontal tubular member, such as 48, 70, does not include a torsion bar 126, the upper horizontal tubular member is pivotably mounted between the apron sections, such as 38*a*, in the same manner as shown and described above, i.e. utilizing hub assemblies such as 114, 116. Torsion bar 126 is omitted, as are torsion bar retainer 128 and torsion bar driver 130. In all other respects, however, the pivotable mounting of the leg arrangement is the same as shown and described previously.

Figure 20:
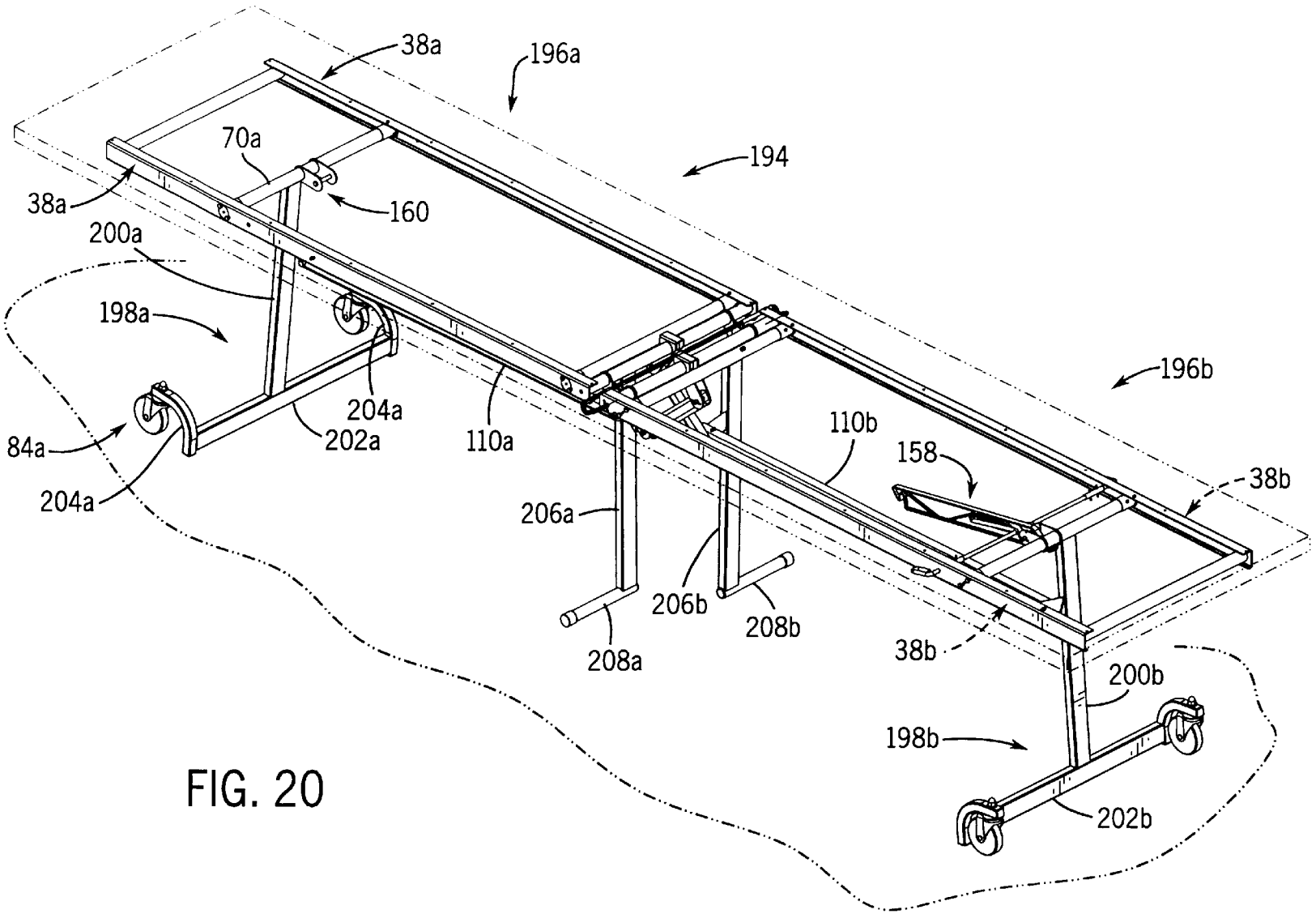
FIG. 20 is an isometric view of another embodiment of a frame for a folding sectional table constructed according to the invention, shown in an unfolded, operative position.
Figure 21:
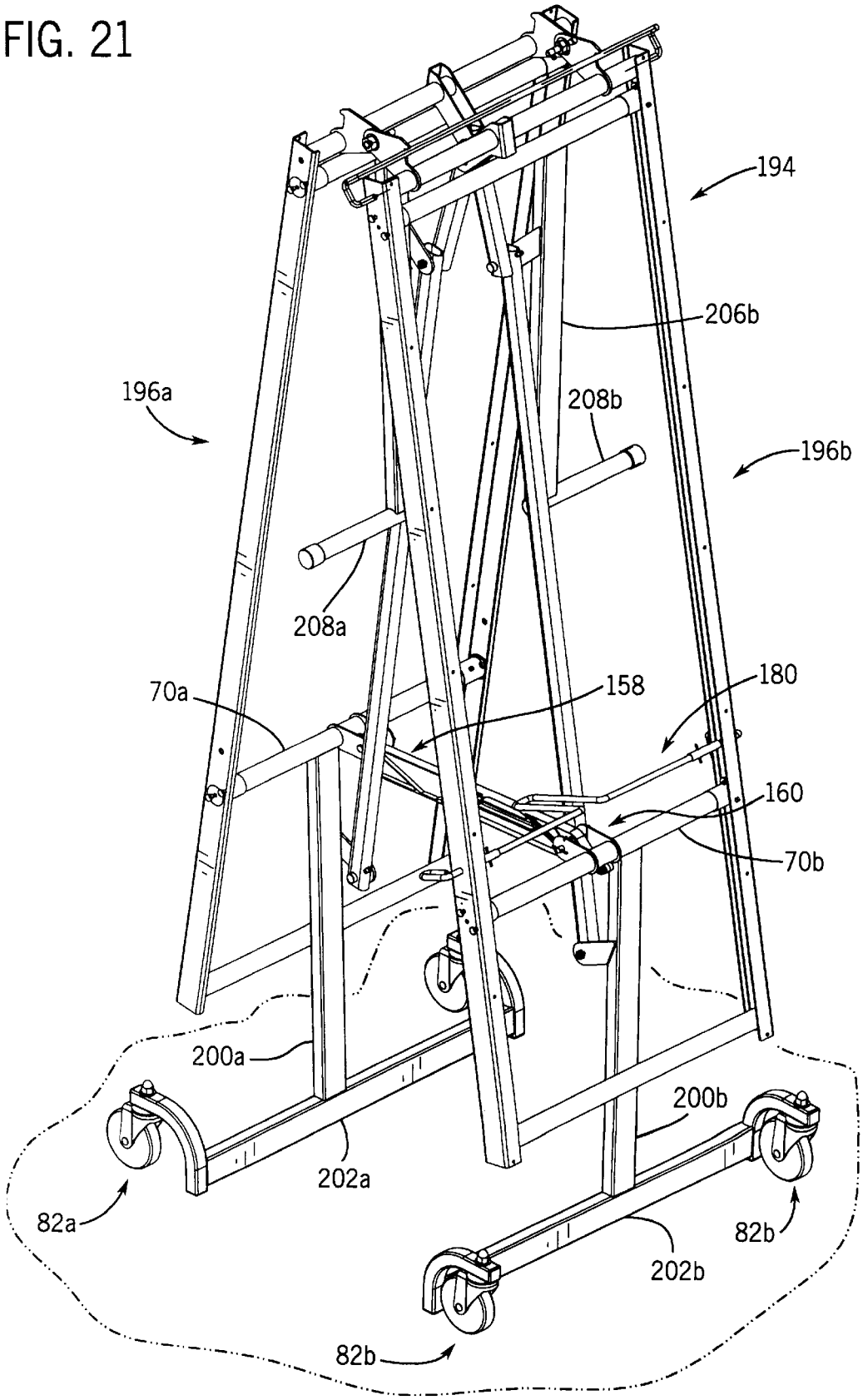
FIG. 21 is a view similar to FIG. 20 showing the frame in a folded, storage position.

FIGS. 20 and 21 illustrate a folding sectional table assembly 194 which includes a pair of table sections 196*a*, 196*b* pivotably interconnected together for movement between an unfolded, operative position of FIG. 20 and a folded, storage position of FIG. 21. Table sections 196*a* and 196*b* are generally similar in construction to table sections 32*a*, 32*b*, respectively, and like reference characters will be used where possible to facilitate clarity. Table sections 196*a*, 196*b* differ from table sections 32*a*, 32*b*, respectively, in that table sections 196*a*, 196*b* have a somewhat different leg structure and do not include a seat frame such as 56 and associating seating components.

Table section 196*a* includes an outer leg assembly 198*a* which includes a central leg member 200*a* and a lower base member 202*a*. A caster assembly 84*a* is mounted to each of a pair of caster mounting arms 204*a*, each of which is secured to an end of lower base member 202*a*. The upper end of central leg member 200*a* is rigidly fixed to upper horizontal tubular member 70*a*, and is pivotable therewith relative to apron members 38*a*.

An inner leg member 206*a* is mounted to upper horizontal tubular member 48*a*, and a foot 208*a* is mounted to the lower end of leg member 206*a*. Leg members 200*a*, 206*a* are interconnected together via tie bar 110*a*, and a linkage arrangement similar to that illustrated in FIG. 6 is interconnected between the frame assembly of each table section and the inner leg member 206 and tie bar 110 of the opposite table section.

Because table assembly 194 does not include any seating components, the overall weight of table assembly 194 is significantly less than that of a table assembly such as 30. Due to this lesser weight, table assembly 194 does not incorporate pneumatic cylinder assemblies such as 146, since the lesser weight of the table sections 196*a*, 196*b* has been found to be more easily managed by a user in lowering table sections 196*a*, 196*b* in lowering and raising table sections 196*a*, 196*b*. In all other respects, however, construction and operation of table assembly 194 is the same as described previously with respect to table assembly 30.

It can thus be appreciated that the folding sectional table assembly of the present invention incorporates a number of features which enhance operation and assembly. The combination of pneumatic cylinders and torsion bars greatly enhances operation of heavy table assemblies such as those which include seats, both in cushioning downward movement of the table sections to the unfolded, operative position and in raising of the table sections for movement toward the folded, storage position. The torsion bar mounting arrangement is combined with the pivotable leg mounting, so as to conceal the torsion bar arrangement and to simplify assembly. In addition, the same basic leg mounting arrangement is used for all leg assemblies, and torsion bars can be selectively employed in desired ones of the leg assemblies according to the overall weight of the table sections. The pneumatic cylinder assemblies act directly at the hinge point between the table sections, providing efficient and effective cushioning and assist during lowering and raising of the table sections. The latch arrangement provides a convenient and reliable mechanism for automatic engagement as the table sections are moved toward the folded, storage position, and can be accessed from either side of the table for disengaging the latch member when it is desired to lower the table sections.

Various alternatives and embodiments are contemplated as being within the scope of the following claims particularly pointing out and distinctly claiming the subject matter regarded as the invention.

I claim:

1. In a folding table assembly including first and second table sections, each of which defines an inner end and an outer end, wherein the table sections are pivotably interconnected at their inner ends for movement of the table assembly between a folded, storage position and an unfolded, operative position, wherein each table section includes a table top and a leg structure pivotably mounted to the table top for supporting the table top above a support surface, the improvement comprising:

a torsion bar arrangement interposed between the table top and the leg structure of each of the table sections for assisting in movement of the table assembly from the unfolded, operative position to the folded, storage position; and a pneumatic cylinder arrangement interposed between the leg structure and each table top, wherein the pneumatic cylinder arrangement cushions the table assembly during movement from the folded, storage position to the unfolded, operative position, and assists in movement of the table assembly away from the unfolded, operative position toward the folded, storage position.

2. The improvement of claim 1, wherein each table section further includes a pair of spaced apart structural apron members, and wherein each torsion bar arrangement extends between and is interconnected with the structural apron members.

3. The improvement of claim 2, wherein the leg structure of each table section includes a pair of cross-members which are pivotably interconnected with and extend between the pair of structural apron members for pivotably mounting the leg structure to the table section for movement relative to the table top.

4. The improvement of claim 3, wherein the torsion bar arrangement includes a torsion bar extending through an internal passage defined by at least one of the cross-members of the leg structure of each table section.

5. The improvement of claim 1, wherein the table sections are interconnected with each other by means of at least one pair of hinge members, wherein each hinge member is mounted to the inner end of one of the table sections, wherein the hinge members are pivotably mounted to each other to form a hinge assembly.

6. The improvement of claim 5, wherein the pneumatic cylinder arrangement comprises an extendible and retractable cylinder assembly interconnected between the hinge assembly and the leg structure of each of the table sections.

7. The improvement of claim 6, wherein each cylinder assembly is pivotably mounted at an upper end to the hinge assembly and at a lower end to one of the leg structures, and is movable to an extended position when the table assembly is moved to its folded, storage position and is movable to a retracted position when the table assembly is moved to its unfolded, operative position, wherein movement of the cylinder assembly toward its retracted position is operable to cushion the table assembly as the table assembly approaches its unfolded, operative position.

8. The improvement of claim 7, wherein each extendible and retractable cylinder assembly is located adjacent one of a pair of spaced sides defined by the table assembly.

9. The improvement of claim 7, further comprising a locking member mounted to one of the table sections and selectively engageable with the hinge members for preventing relative movement between the hinge members when the table assembly is in its unfolded, operative position for preventing movement of the table assembly away from its unfolded, operative position, and is disengageable from the hinge members for allowing movement of the table assembly to its folded, storage position.

10. In a folding table assembly including first and second table sections, each of which defines an inner end and an outer end, wherein the table sections are pivotably interconnected at their inner ends for movement of the table assembly between a folded, storage position and an unfolded, operative position, wherein each table section includes a table top and a frame including a pair of spaced apart structural apron members mounted to the table top and a pivotable leg arrangement for supporting the table top above a supporting surface, the improvement comprising a torsion bar arrangement interconnected with the frame for assisting in movement of the table assembly from the unfolded, operative position to the folded, storage position, wherein the torsion bar arrangement includes a torsion bar defining a pair of spaced ends, a pair of hub members mounted one to each structural apron member of at least one of the table sections, wherein each hub member includes a sleeve, and wherein each hub member is fixed to one of the apron members, wherein the leg arrangement includes an upper cross-member defining a pair of spaced ends, each of which is received within one of the sleeves for pivotably mounting the leg arrangement to and between the hub members, wherein the torsion bar is fixed against rotation to one of the hub members at a first location and, at a second location spaced from the first location, is fixed against rotation to the upper cross-member of the leg arrangement, wherein torque is imparted to the torsion bar by rotation of the upper cross-member within the sleeves as the table assembly is moved from the folded, inoperative position toward the unfolded, operative position.

11. The improvement of claim 10, wherein torque is imparted to the torsion bar by means of a torsion bar driver member fixed within an internal passage defined by the upper cross-member.

12. The improvement of claim 11, wherein the torsion bar defines a non-circular cross-section, and wherein one of the hub members includes a torsion bar retainer located within the sleeve, wherein the torsion bar retainer defines a recess having a cross-section corresponding to that of the torsion bar for non-rotatably mounting one end of the torsion bar to the hub member, and wherein the torsion bar driver member defines a non-circular opening having a cross-section corresponding to that of the torsion bar and within which the torsion bar is received for non-rotatably mounting the torsion bar to the upper cross-member of the leg arrangement.

13. The improvement of claim 10, wherein each hub member comprises a mounting flange member fixedly mounted to one of the structural apron members, and wherein the sleeve is fixed to and extends from the mounting flange member.

14. In a folding table assembly including first and second table sections, each of which defines an inner end and an outer end, wherein the table sections are pivotably interconnected at their inner ends for movement of the table assembly between a folded, storage position and an unfolded, operative position, wherein each table section includes a table top and leg structure pivotably mounted to the table top for supporting the table top above a supporting surface, the improvement comprising at least one pair of hinge members pivotably interconnected with each other to form a hinge assembly, each hinge member of the pair of hinge members being mounted to one of the table sections, and at least one extendible and retractable cylinder assembly, wherein each cylinder assembly defines a first end interconnected with the hinge assembly and a second end interconnected with one of the leg structures, wherein each leg structure is pivotable relative to the table top upon movement of the table assembly between its unfolded, operative position and its folded, storage position, wherein pivoting movement of the leg structure relative to the table top function to move each cylinder assembly between an extended position and a retracted position, wherein the cylinder assembly is operable to cushion movement of the table assembly as the table assembly approaches its unfolded, operative position from its folded, storage position.

15. The improvement of claim 14, wherein the pair of hinge members are pivotably interconnected with each other for movement about a pivot axis located between the table sections, and wherein the first end of each extendible and retractable cylinder assembly is interconnected with the hinge members at a location coincident with the pivot axis.

16. The improvement of claim 14, wherein the first and second table sections are interconnected by means of two pairs of spaced apart pivoting hinge members, wherein each pair of hinge members is interconnected with each other by means of a pivot pin and wherein the pivot pins define the pivot axis about which the hinge members are pivotable, and wherein the at least one cylinder assembly comprises a pair of extendible and retractable cylinder assemblies, wherein each cylinder assembly is interconnected at a first end with one of the pivot pins and at a second end with one of the leg structures.

17. The improvement of claim 16, wherein the second end of each cylinder assembly is interconnected with one of the leg structures by means of a pivot connection interposed between the second end of the cylinder assembly and the leg structure.

18. The improvement of claim 17, wherein each leg structure defines an upper end pivotably interconnected between a pair of structural apron members to which the table top is mounted, for providing pivoting movement of the leg structure relative to the table top.

19. The improvement of claim 15, wherein each hinge member is mounted to a cross-member located adjacent the inner end of one of the table sections.

20. The improvement of claim 19, wherein the cross-member of each of the table sections is interconnected with the leg arrangement of the other of the table sections by means of a link member, wherein the link members are operable to provide pivoting movement of the leg structures relative to the table sections when the table assembly is moved between its unfolded, operative position and its folded, storage position.

* * * * *

UNITED STATES PATENT AND TRADEMARK OFFICE

CERTIFICATE OF CORRECTION

PATENT NO. : 6,223,661 B1
DATED : May 1, 2001
INVENTOR(S) : Dennis G. Griepentrog It is certified that error appears in the above-identified patent and that said Letters Patent is hereby corrected as shown below:

Column 13,
Line 38, delete “function” and substitute therefore -- functions --;

Column 14,
Line 9, delete “14” and substitute therefor -- 15 --.

Signed and Sealed this

Fourth Day of February, 2003

JAMES E. ROGAN
*Director of the United States Patent and Trademark Office*